US009057386B2

(12) United States Patent
Binek et al.

(10) Patent No.: US 9,057,386 B2
(45) Date of Patent: Jun. 16, 2015

(54) RAM AIR FAN INNER HOUSING

(75) Inventors: Lawrence Binek, Windsor, CT (US); Eric Chrabascz, Longmeadow, MA (US); David A. Dorman, Feeding Hills, MA (US)

(73) Assignee: Hamilton Sundstrand Corporation, Windsor Locks, CT (US)

( * ) Notice: Subject to any disclaimer, the term of this patent is extended or adjusted under 35 U.S.C. 154(b) by 833 days.

(21) Appl. No.: 13/279,497

(22) Filed: Oct. 24, 2011

(65) Prior Publication Data

US 2013/0101400 A1 Apr. 25, 2013

(51) Int. Cl.
*F04D 29/42* (2006.01)
*F04D 29/52* (2006.01)

(52) U.S. Cl.
CPC ..... *F04D 29/522* (2013.01); *Y10T 29/49323* (2015.01)

(58) Field of Classification Search
CPC ..... F04D 25/08; F04D 25/082; F04D 29/522; F05D 2220/10; F05D 2220/34; F05D 2220/50; F05D 2240/90; F05D 2240/91; F05D 2260/31; F05B 2220/10; F05B 2220/34; F05B 2220/50; F05B 2240/90; F05B 2240/91
USPC ..... 60/39.83; 244/118.5, 53 B, 57, 58; 415/108, 175, 176, 182.1, 196, 197, 415/207
See application file for complete search history.

(56) References Cited

U.S. PATENT DOCUMENTS

| | | | | | |
|---|---|---|---|---|---|
| 1,940,466 | A | | 12/1933 | Sneed | |
| 2,223,847 | A | * | 12/1940 | Engdahl | 384/476 |
| 2,397,171 | A | * | 3/1946 | Troller et al. | 417/368 |
| 2,527,229 | A | | 10/1950 | Roubal | |
| 2,752,515 | A | | 6/1956 | Baudry et al. | |
| 3,410,029 | A | | 11/1968 | Savage | |
| 3,433,020 | A | | 3/1969 | Earle, Jr. et al. | |
| 3,588,044 | A | | 6/1971 | Reichrath et al. | |
| 3,763,835 | A | | 10/1973 | Miller et al. | |
| 3,915,024 | A | | 10/1975 | Mort | |
| 3,949,550 | A | | 4/1976 | Albrecht et al. | |
| 3,999,872 | A | | 12/1976 | Allison | |
| 4,012,154 | A | | 3/1977 | Durwin et al. | |
| 4,137,992 | A | * | 2/1979 | Herman | 181/213 |
| 4,439,106 | A | | 3/1984 | Ferris et al. | |
| 4,511,193 | A | | 4/1985 | Geczy | |
| 4,543,785 | A | | 10/1985 | Patrick | |
| 4,979,872 | A | | 12/1990 | Myers et al. | |
| 5,239,815 | A | | 8/1993 | Barcza | |
| 5,350,281 | A | * | 9/1994 | Hagshenas | 417/371 |
| 5,505,587 | A | | 4/1996 | Ghetzler | |
| 5,529,316 | A | | 6/1996 | Mattila | |
| 5,683,184 | A | | 11/1997 | Striedacher et al. | |

(Continued)

OTHER PUBLICATIONS

Colson et al., U.S. Appl. No. 13/279,588, filed Oct. 24, 2011.

(Continued)

*Primary Examiner* — Dwayne J White
*Assistant Examiner* — Ryan Ellis
(74) *Attorney, Agent, or Firm* — Kinney & Lange, P.A.

(57) ABSTRACT

A ram air fan inner housing for a ram air fan assembly comprises a center body housing, an end cup attached to the center body housing, and a perforated cone. The perforated cone is attached to the center body housing and the end cup such that the perforated cone extends away from the center body housing and radially inward toward an axis of the inner housing.

19 Claims, 3 Drawing Sheets

(56) References Cited

U.S. PATENT DOCUMENTS

| | | | | |
|---|---|---|---|---|
| 6,299,077 | B1 | 10/2001 | Harmon et al. | |
| 6,380,647 | B2 | 4/2002 | Hayashi et al. | |
| 6,657,332 | B2 * | 12/2003 | Balas | 310/58 |
| 6,698,933 | B2 | 3/2004 | Lau | |
| 6,926,490 | B2 | 8/2005 | McAuliffe et al. | |
| 6,928,963 | B2 | 8/2005 | Karanik | |
| 6,966,174 | B2 | 11/2005 | Paul | |
| 7,165,939 | B2 | 1/2007 | Chen et al. | |
| 7,342,332 | B2 * | 3/2008 | McAuliffe et al. | 310/58 |
| 7,394,175 | B2 * | 7/2008 | McAuliffe et al. | 310/58 |
| 7,397,145 | B2 | 7/2008 | Struve et al. | |
| 7,757,502 | B2 * | 7/2010 | Merritt et al. | 62/172 |
| 7,952,241 | B2 | 5/2011 | Kato et al. | |
| 2002/0171218 | A1 | 11/2002 | Bell | |
| 2006/0061221 | A1 | 3/2006 | McAuliffe et al. | |
| 2010/0055383 | A1 | 3/2010 | Schalla et al. | |

OTHER PUBLICATIONS

Colson et al., U.S. Appl. No. 13/279,529, filed Oct. 24, 2011.
Colson et al., U.S. Appl. No. 13/279,538, filed Oct. 24, 2011.
Rosen et al., U.S. Appl. No. 13/279,488, filed Oct. 24, 2011.
Binek et al., U.S. Appl. No. 13/279,508, filed Oct. 24, 2011.
Chrabascz et al., U.S. Appl. No. 13/279,523, filed Oct. 24, 2011.
Chrabascz et al., U.S. Appl. No. 13/279,534, filed Oct. 24, 2011.
Rosen et al., U.S. Appl. No. 13/279,576, filed Oct. 24, 2011.

* cited by examiner

RAM AIR FAN INNER HOUSING

BACKGROUND

The present invention relates to an environmental control system. In particular, the invention relates to an inner housing of a ram air fan assembly for an environmental control system for an aircraft.

An environmental control system (ECS) aboard an aircraft provides conditioned air to an aircraft cabin. Conditioned air is air at a temperature, pressure, and humidity desirable for aircraft passenger comfort and safety. At or near ground level, the ambient air temperature and/or humidity is often sufficiently high that the air must be cooled as part of the conditioning process before delivered to the aircraft cabin. At flight altitude, ambient air is often far cooler than desired, but at such a low pressure that it must be compressed to an acceptable pressure as part of the conditioning process. Compressing ambient air at flight altitude heats the resulting pressurized air sufficiently that it must be cooled, even if the ambient air temperature is very low. Thus, under most conditions, heat must be removed from air by the ECS before the air is delivered to the aircraft cabin. As heat is removed from the air, it is dissipated by the ECS into a separate stream of air that flows into the ECS, across heat exchangers in the ECS, and out of the aircraft, carrying the excess heat with it. Under conditions where the aircraft is moving fast enough, the pressure of air ramming into the aircraft is sufficient to move enough air through the ECS and over the heat exchangers to remove the excess heat.

While ram air works well under normal flight conditions, at lower flight speeds, or when the aircraft is on the ground, ram air pressure is too low to provide enough air flow across the heat exchangers for sufficient heat removal from the ECS. Under these conditions, a fan within the ECS is employed to provide the necessary airflow across the ECS heat exchangers. This fan is called a ram air fan.

As with any system aboard an aircraft, there is great value in an improved ram air fan that includes innovative components, such as an inner housing designed to improve the operational efficiency of the ram air fan, reduce its weight, or reduce noise generated by the aircraft.

SUMMARY

The present invention is a ram air fan inner housing for a ram air fan assembly. The inner housing comprises a center body housing, an end cup attached to the center body housing, and a perforated cone. The perforated cone is attached to the center body housing and the end cup such that the perforated cone extends away from the center body housing and radially inward toward an axis of the inner housing.

DETAILED DESCRIPTION

Ram air fan assemblies in environmental control systems (ECS) typically require a flow of cooling air directed toward a motor and bearings employed to drive a ram air fan rotor.

Also, as a flow of air is generated by the fan rotor and directed through the ram air fan assembly, the manner in which the flow of air is directed influences both flow efficiency and noise generation.

The present invention is an inner housing for a ram air fan that helps direct a flow of air from a ram air fan rotor in such a way as to diffuse the fan air flow and enhance flow efficiency. In addition, an inner housing that embodies the present invention also connects a flow of cooling air from a motor bearing cooling tube to a bearing housing to provide a flow of cooling air to the motor and bearings, the flow being sufficient for the cooling needs of the ram air fan assembly, while providing a volume sufficient to contain a necessary noise abatement structure.

Figure 1:
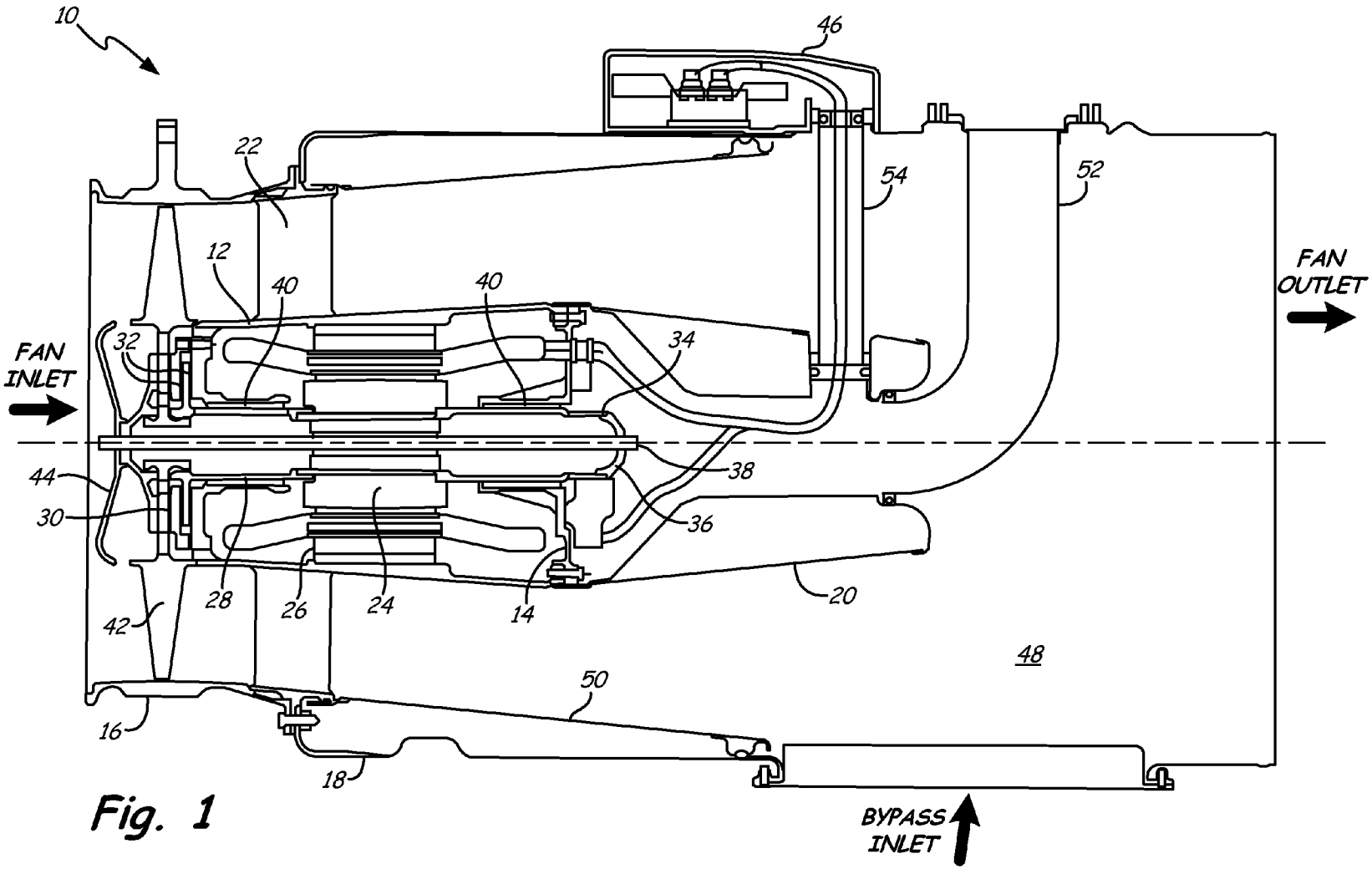
FIG. 1 is a side view of a ram air fan assembly incorporating the present invention.

FIG. 1 illustrates a ram air fan air assembly incorporating the present invention. FIG. 1 shows ram air fan assembly 10 including fan housing 12, bearing housing 14, inlet housing 16, outer housing 18, and inner housing 20. Fan housing 12 includes fan struts 22, motor rotor 24, motor stator 26, thrust shaft 28, thrust plate 30, and thrust plate 32. Bearing housing 14 includes journal bearing shaft 34 and shaft cap 36. Fan housing 12 and bearing housing 14 together include tie rod 38 and journal bearings 40. Inlet housing 16 contains fan rotor 42 and inlet shroud 44, in addition to a portion of tie rod 38. Outer housing 18 includes terminal box 46 and plenum 48. Within outer housing 18 are diffuser 50, motor bearing cooling tube 52, and wire transfer tube 54. A fan inlet is a source of air to be moved by ram air fan assembly 10 in the absence of sufficient ram air pressure. A bypass inlet is a source of air that moves through ram air fan assembly 10 when sufficient ram air pressure is available.

As illustrated in FIG. 1, inlet housing 16 and outer housing 18 are attached to fan housing 12 at fan struts 22. Bearing housing 14 is attached to fan housing 12 and inner housing 20 connects motor bearing cooling tube 52 and wire transfer tube 54 to bearing housing 14. Motor bearing cooling tube 52 connects inner housing 20 to a source of cooling air at outer housing 18. Wire transfer tube 54 connects inner housing 20 to outer housing 18 at terminal box 46. Motor stator 26 and thrust plate 30 attach to fan housing 12. Motor rotor 24 is contained within motor stator 26 and connects journal bearing shaft 34 to thrust shaft 28. Journal bearing shaft 34, motor rotor 24, and thrust shaft 28 define an axis of rotation for ram air fan assembly 10. Fan rotor 42 is attached to thrust shaft 28 with tie rod 38 extending along the axis of rotation from shaft cap 36 at the end of journal bearing shaft 34 through motor rotor 24, thrust shaft 38, and fan rotor 42 to inlet shroud 44. Nuts (not shown) secure shaft cap 36 to journal bearing shaft 34 on one end of tie rod 38 and inlet shroud 44 to fan rotor 42 at opposite end of tie rod 38. Thrust plate 30 and fan housing 12 contain a flange-like portion of thrust shaft 28, with thrust bearings 32 positioned between the flange-like portion of thrust shaft 28 and thrust plate 30; and between the flange-like portion of thrust shaft 28 and fan housing 12. Journal bearings 40 are positioned between journal bearing shaft 24 and bearing housing 14; and between thrust shaft 28 and fan housing 12. Inlet shroud 44, fan rotor 42, and a portion of fan housing 12 are contained within inlet housing 16. Diffuser 50 is attached to an inner surface of outer housing 18. Plenum 48 is a portion of outer housing 18 that connects ram air fan assembly 10 to the bypass inlet. Inlet housing 16 is connected to the fan inlet and outer housing 18 is connected to the fan outlet.

In operation, ram air fan assembly 10 is installed into an environmental control system aboard an aircraft and connected to the fan inlet, the bypass inlet, and the fan outlet. When the aircraft does not move fast enough to generate sufficient ram air pressure to meet the cooling needs of the ECS, power is supplied to motor stator 26 by wires running from terminal box 46, through wire transfer tube 54, inner housing 20, and bearing housing 14. Energizing motor stator 26 causes rotor 24 to rotate about the axis of rotation for ram air fan assembly 10, rotating connected journal bearing shaft 34 and thrust shaft 28. Fan rotor 42 and inlet shroud 44 also rotate by way of their connection to thrust shaft 28. Journal bearings 40 and thrust bearings 32 provide low friction support for the rotating components. As fan rotor 42 rotates, it moves air from the fan inlet, through inlet housing 20, past fan struts 22 and into the space between fan housing 12 and outer housing 18, increasing the air pressure in outer housing 18. As the air moves through outer housing 18, the air flows past diffuser 50 and inner housing 20, where the air pressure is reduced due to the shape of diffuser 50 and the shape of inner housing 20. Once past inner housing 20, the air moves out of outer housing 18 at the fan outlet. Components within bearing housing 14 and fan housing 12, especially thrust bearings 32, journal bearings 40, motor stator 26, and motor rotor 24; generate significant heat and must be cooled. Cooling air is provided by motor bearing cooling tube 52 which directs a flow of cooling air to inner housing 20. Inner housing 20 directs flow of cooling air to bearing housing 14, where it flows past components in bearing housing 14 and fan housing 12, cooling the components. Once the aircraft moves fast enough to generate sufficient ram air pressure to meet the cooling needs of the ECS, ram air is directed into plenum 48 from the bypass inlet. The ram air passes into outer housing 18 at plenum 48 and moves out of outer housing 18 at the fan outlet.

Figure 2A:
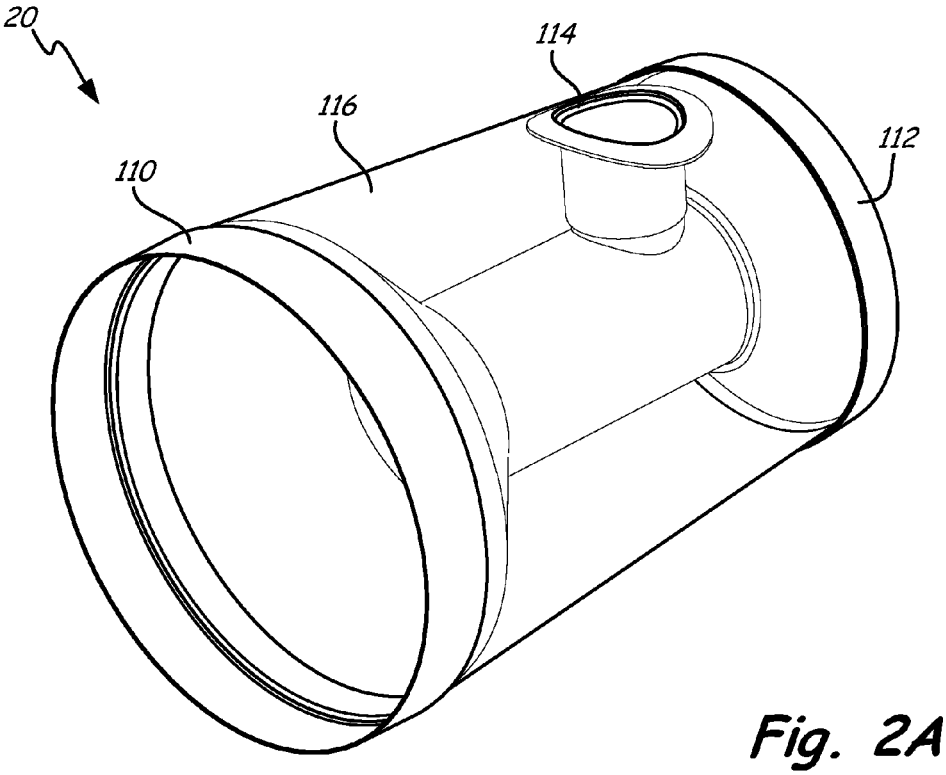
FIGS. 2A and 2B are perspective views of an embodiment of an inner housing incorporating the present invention.
Figure 2B:
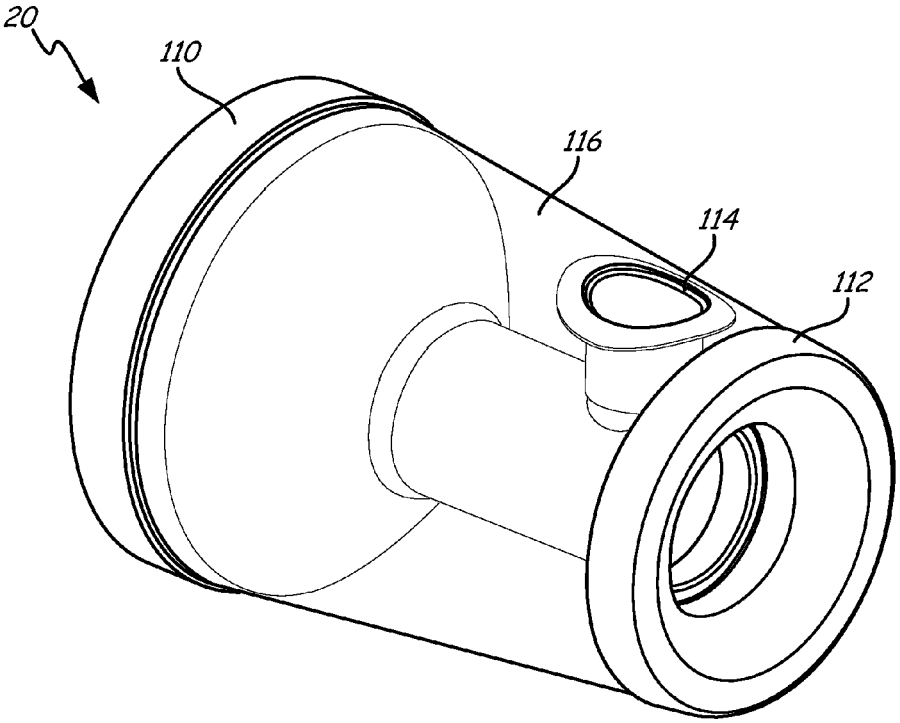

FIGS. 2A and 2B are perspective views of an embodiment of an inner housing incorporating the present invention. As shown in FIGS. 2A and 2B, inner housing 20 includes center body housing 110, end cup 112, ring seal 114, and perforated cone 116. Center body housing 110 extends most of the length of inner housing 20. Center body housing 110 is an end of inner housing 20 that connects to bearing housing 14, as shown in FIG. 1. End cup 112 is another end of inner housing 20 that connects to motor bearing cooling tube 52, as shown in FIG. 1. End cup 112 is attached to center body housing 110 to provide a path for cooling air from motor bearing cooling tube 52 to bearing housing 14. Center body housing 110, end cup 112, and ring seal 114 are made of any durable, lightweight material, for example, a fiber-reinforced polymer composite, such as a laminated structure of plain-weave carbon-fiber fabric held together by a durable resin. Perforated cone 116 is a sheet of metal, for example, titanium, with a plurality of small perforations and one large opening. Perforated cone 116 is attached to center body housing 110 and to end cup 112 to create a frustoconical shape disposed about the axis of inner housing 20. The frustoconical shape of perforated cone 116 defines most of the exterior shape of inner housing 20. Ring seal 114 is attached to center body housing 110 and to perforated cone 116 around the large opening in perforated cone 116 near end cup 112. Ring seal 114 connects to wire transfer tube 54.

As noted above in reference to FIG. 1, in operation, a flow of cooling air for components within bearing housing 14 and fan housing 12 is provided by motor bearing cooling tube 52 by way of inner housing 20. As shown in FIGS. 2A and 2B, the passage for the flow of cooling air is from end cup 112, into a narrow portion of center body housing 110, through a widening portion of center body housing 110, to the end of inner housing 20 that connects to bearing housing 14. Also as noted above, power is supplied to motor stator 26 by wires running from terminal box 46, through wire transfer tube 54, inner housing 20, and bearing housing 14. As shown in FIGS. 2A and 2B, the passage for the wires is from ring seal 114, into the narrow portion of center body housing 110, through the widening portion of center body housing 110, to the end of inner housing 20 that connects to bearing housing 14. Meanwhile, as shown in FIG. 1, the air flow from the rotation of fan rotor 42 moves into outer housing 18, flowing into a space defined by diffuser 50 and inner housing 20. Due largely to increasing volume provided by the frustoconical shape of inner housing 20, air pressure and flow velocity of the air flow are both reduced, resulting in improved flow efficiency from the lower air pressure, and noise reduction from the lower flow velocity. In addition, interaction between the air flow over perforated cone 116 also results in noise abatement as described below in reference to FIG. 3.

Figure 3:
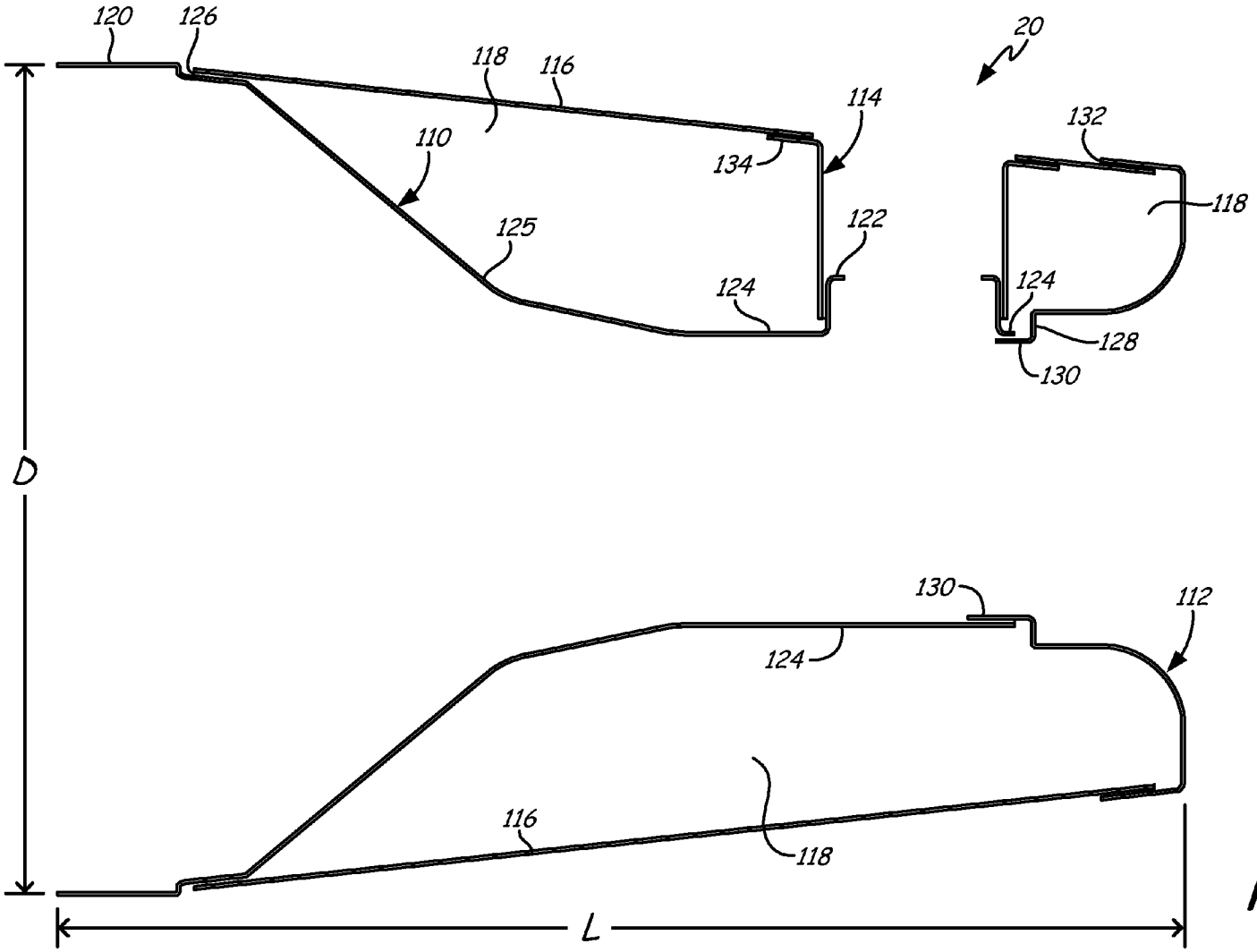
FIG. 3 is a cross-sectional view of the inner housing of FIGS. 2A and 2B.

FIG. 3 is a cross-sectional view of inner housing 20 of FIGS. 2A and 2B. FIG. 3 shows that center body housing 110 is a single-piece structure that comprises bearing housing connection 120, wire inlet 122, cooling air inlet 124, and cooling duct 125. Cooling duct 125 includes first cone attachment surface 126. Bearing housing connection 120 has a cylindrical shape disposed symmetrically about an axis of inner housing 20. Cooling air inlet 124 also has a cylindrical shape and is at an end of center body housing 110 opposite bearing housing connection 120. Cooling duct 125 extends from cooling air inlet 124 to bearing housing connection 120. Cooling duct 125 is a series of frustoconical sections disposed symmetrically about the axis of inner housing 20, including first cone attachment surface 126. First cone attachment surface 126 is a radially outward facing surface of cooling duct 125 adjacent to bearing housing 120. Wire inlet 122 is a cylindrically shaped duct with an axis intersecting the axis of inlet housing 20 at a right angle. Wire inlet 122 extends radially outward from an opening in a surface of cooling air inlet 124.

FIG. 3 also illustrates that end cup 112 is a single-piece structure that comprises cooling tube recess 128, cooling air connector 130, and second cone attachment surface 132. Cooling air connector 130 extends parallel to the axis of inner housing 20. Cooling air connector 130 fits within cool air inlet 124 to connect end cup 112 to center body housing 110. As illustrated in FIG. 3, a portion of cooling air connector 130 is shortened such that when fitted within cool air inlet 124 and properly aligned, it does not cover the opening in the surface of cooling air inlet 124 for wire inlet 122. The joint between cooling air connector 130 and cool air inlet 124 is secured with permanent adhesive. Second cone attachment surface 132 has a frustoconical shape and is a radially inward facing surface of a portion of end cup 112 most radially distant from the axis of inner housing 20. Second cone attachment surface 132 is also disposed symmetrically about the axis of inner housing 20. Cooling tube recess 128 connects cooling air connector 130 and the portion of end cup 112 most radially distant from the axis of inner housing 20. Cooling tube recess 128 is shaped to accommodate the "J" shape of motor bearing cooling tube 52, as illustrated in FIG. 1.

Ring seal 114 includes ring seal flange 134. Ring seal flange 134 is shaped to accommodate the external shape of inner housing 20. An end of ring seal 114 opposite ring seal flange 134 fits around wire inlet 122 and is aligned such that a portion of ring seal flange 134 most radially distant from the axis of inner housing 20 is closest to bearing housing connection 120. The joint between ring seal 114 and wire inlet 122 is secured by permanent adhesive.

As illustrated in FIG. 3, perforated cone 116 is formed into a frustoconical shape disposed about the axis of inner housing 20 by attachment to first cone attachment surface 126 and second cone attachment surface 132, and is aligned such that the large opening in perforated cone 116 is centered over ring seal flange 134. The joints between perforated cone 116 and each of first cone attachment surface 126, second cone attachment surface 132, and ring seal flange 134 are secured by permanent adhesive. As noted above, the attachment of perforated cone 116 to center body housing 110 and to end cup 112 creates a frustoconical shape that defines most of the exterior shape of inner housing 20. In one embodiment, perforated cone 116 extends away from first cone attachment surface 126 and radially inward toward the axis of inner housing 20 at an angle of about 5.4 degrees from the axis of inner housing 20. In another embodiment, perforated cone 116 extends away from first cone attachment surface 126 and radially inward toward the axis of inner housing 20 at an angle between 5.2 degrees and 5.6 degrees from the axis of inner housing 20.

As shown in FIG. 3, attachment of perforated cone 116 to first cone attachment surface 126 and second cone attachment surface 132 defines a volume between perforated cone 116 and center body housing 110 and between perforated cone 116 and end cup 112. In the embodiment of FIG. 3, this volume contains a noise abatement structure in the form of acoustic foam 118. Acoustic foam 118 is any of the acoustic foams known in the art for damping acoustical vibrations. In one embodiment, acoustic foam 118 is inserted into the volume prior to the permanent attachment of perforated cone 116 to first cone attachment surface 126 and second cone attachment surface 132. In another embodiment, acoustic foam 118 is injected into the volume through at least one perforation in perforated cone 116 after the permanent attachment of perforated cone 116 to first cone attachment surface 126 and second cone attachment surface 132. In combination with perforations of perforated cone 116, acoustic foam 118 damps acoustical vibrations in the air flow past inner housing 20.

In addition to the angle of perforated cone 116 described above, the shape of inner housing 20 is determined by a ratio of a length of inner housing 20 to a diameter of inner housing. The length (L) of inner housing 20 is an external length of inner housing 20 in a direction parallel to the axis of inner housing 20, as shown in FIG. 3. The diameter (D) of inner housing 20 is an external diameter of bearing housing connection 120. So defined, one embodiment of the present invention has a ratio L over D of not less than 1.347. Another embodiment has a ratio of L over D of no less than 1.347 and no greater than 1.368. In a third embodiment, L is between 10.275 inches and 10.395 inches (or between 260.99 mm and 264.03 mm); and D is between 7.600 inches and 7.630 inches (or between 193.04 mm and 194.80 mm). This feature ensures that for a given D of inner housing 20, inner housing 20 extends far enough along the path of air flow from bearing housing 14 to control the diffusion of the air flow and provide a sufficient length over which perforated cone 116 and acoustic foam 118 can damp acoustical vibrations.

Thus shaped, inner housing 20 directs air flow from fan rotor 42 through ram air fan assembly 10 and, by creating an increasing cross-sectional area into which the air flow from fan rotor 42 can diffuse, reduces air pressure and flow velocity of the air flow resulting in improved flow efficiency from the lower air pressure, and noise reduction from the lower flow velocity and greater length for damping acoustical vibrations.

As noted above, inner housing 20 must also provide a flow of cooling air from motor bearing cooling tube 52 to bearing housing 14. There is a limit to the pressure at which the flow of cooling air can be provided from motor bearing cooling tube 52, yet the flow of cooling air must be sufficient to cool components within bearing housing 14 and fan housing 12. Cooling air inlet 124 is the narrowest portion of cooling air flow path through center body housing 110 and determines the volume of cooling air that flows to bearing housing 14 for an available cooling air flow pressure from motor bearing cooling tube 52. In one embodiment of the present invention, cooling air inlet 124 has an external diameter no less than 2.685 inches (or 68.20 mm) to ensure a flow of cooling air sufficient for ram air fan assembly 10. Cooling air inlet 124 of a larger external diameter is able to provide a greater volume of cooling air flow, but only by expanding into the volume for containing acoustic foam 118, reducing the amount of acoustic foam 118, and reducing the damping of acoustical vibrations. Conversely, cooling air inlet 124 of a smaller external diameter increases the volume available for acoustic foam 118, thereby increasing the damping of acoustical vibrations, but reducing the volume of cooling air flow to bearing housing 14. In another embodiment, cooling air inlet 124 has an external diameter between 2.685 inches and 2.715 inches (or between 68.20 mm and 68.96 mm) to balance these two competing requirements.

As shown in FIG. 1, inner housing 20 is easily accessible from the fan outlet end of ram air fan assembly 10, which greatly simplifies replacement of inner housing 20, beginning with removal of ram air fan assembly 10 from the aircraft. Ram air fan assembly 10 is a line-replaceable unit (LRU). LRUs are designed to be installed and removed easily and efficiently such that a new unit can replace a unit in need of repair or inspection quickly, getting the aircraft back into service while the LRU removed is taken elsewhere for repair or inspection. Considering FIGS. 1, 2A, 2B and 3 together, removal of inner housing 20 from ram air fan assembly 10 begins by disconnecting motor bearing cooling tube 52 from end cup 112 of inner housing 20. Next, electrical wires are disconnected from terminal box 46 and pulled into inner housing 20 through ring seal 114. Wire transfer tube 54 is then disconnected from ring seal 114 and inner housing 20 is pulled away from bearing housing 14 to detach bearing housing connection 120 from bearing housing 14. Finally, inner housing 20 is removed from ram air fan assembly 10 through the fan outlet end of ram air fan assembly 10. Installing inner housing 20 begins with inserting inner housing 20 into the fan outlet end of ram air fan assembly 10 while pulling the electrical wires attached to bearing housing 14 into inner housing 20 and attaching inner housing 20 by connecting bearing housing connection 120 to bearing housing 14. Next, wire transfer tube 54 is connected to ring seal 114 and then the electrical wires are fed through ring seal 114 and through wire transfer tube 54 to terminal box 46, where the electrical wires are connected to terminal box 46. Motor bearing cooling tube 52 is connected to end cup 112 to complete the installation of inner housing 20 into ram air fan assembly 10. The final step is installing ram air fan assembly 10 with newly installed replacement inner housing 20 back into the aircraft.

An inner housing for a ram air fan assembly that embodies the present invention has a frustoconical exterior shape determined by a specific range of angles with respect to an axis of the inner housing. Combined with a relatively large ratio of external length over external diameter of the inner housing, the exterior shape directs a flow of air from a fan rotor within the ram air fan assembly to diffuse the flow and enhance flow efficiency. In addition, the inner housing has a cooling air inlet within the inner housing having a diameter large enough to provide a flow of cooling air sufficient for the ram air fan assembly, but small enough that the volume for acoustic foam remains large enough for adequate damping of acoustical vibrations.

Novel aspects of inner housing 20, including the angle of perforated cone 116, the ratio of external length to external diameter, and the external diameter of cooling air inlet 124 of the present invention described herein are achieved by substantial conformance to specified geometries. It is understood that edge breaks and curved radii not specifically described herein, but normally employed in the art, may be added to inner housing 20 to enhance manufacturability, ease assembly, or improve durability while retaining substantial conformance to specified geometries.

Alternatively, substantial conformance is based on a determination by a national or international regulatory body, for example in a part certification or parts manufacture approval (PMA) process for the Federal Aviation Administration, the European Aviation Safety Agency, the Civil Aviation Administration of China, the Japan Civil Aviation Bureau, or the Russian Federal Agency for Air Transport. In these embodiments, substantial conformance encompasses a determination that a particular ram air fan inner housing is identical to, or sufficiently similar to, the specified inner housing 20, or that the ram air fan inner housing is sufficiently the same with respect to a part design in a type-certified ram air fan inner housing, such that the ram air fan inner housing complies with airworthiness standards applicable to the specified ram air fan inner housing. In particular, substantial conformance encompasses any regulatory determination that a particular part or structure is sufficiently similar to, identical to, or the same as a specified inner housing 20 of the present invention, such that certification or authorization for use is based at least in part on the determination of similarity.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) disclosed, but that the invention will include all embodiments falling within the scope of the appended claims.

The invention claimed is:

1. A ram air fan inner housing for a ram air fan assembly, the inner housing comprising:
- a center body housing comprising:
  - a bearing housing connection at one end of the center body housing, the bearing housing connection having a cylindrical shape and disposed symmetrically about an axis of the inner housing;
  - a cooling air inlet having a cylindrical shape at an end of the center body opposite the bearing housing connection; and
  - a cooling duct between the bearing housing connection and the cooling air inlet, the cooling duct comprising:
    - a first cone attachment surface adjacent to the bearing housing connection, the first cone attachment surface having a frustoconical shape and disposed symmetrically about the axis of the inner housing;
- an end cup attached to the center body housing, the end cup comprising:
  - a cooling air connector for connecting the end cup to the cooling air inlet;
  - a second cone attachment surface having a frustoconical shape and disposed symmetrically about the axis of the inner housing; and
  - a cooling tube recess between the cooling air connector and the second cone attachment surface, the cooling tube recess for connecting a motor bearing cooling tube;
- a perforated cone having a frustoconical shape and disposed axially about the center body housing;
- wherein the perforated cone is attached to the center body housing at the first cone attachment surface and attached to the end cup at the second cone attachment surface such that the perforated cone extends away from the first cone attachment surface and radially inward toward the axis of the inner housing.

2. The inner housing of claim 1, wherein the perforated cone extends away from the first cone attachment surface and radially inward toward the axis of the inner housing at an angle of between 5.2 degrees and 5.6 degrees from the axis of the inner housing.

3. The inner housing of claim 1, wherein the perforated cone extends away from the first cone attachment surface and radially inward toward the axis of the inner housing at an angle of about 5.4 degrees from the axis of the inner housing.

4. The inner housing of claim 1, wherein a ratio of an external length of the inner housing to an external diameter of the bearing housing connection is no less than 1.347, wherein the external length of the inner housing is a distance in a direction parallel to the axis of the inner housing.

5. The inner housing of claim 1, wherein a ratio of an external length of the inner housing to an external diameter of the bearing housing connection is no less than 1.347 and no greater than 1.368, wherein the external length of the inner housing is a distance in a direction parallel to the axis of the inner housing.

6. The inner housing of claim 1, wherein an external length of the inner housing is between 10.275 inches and 10.395 inches (or between 260.99 mm and 264.03 mm) and an external diameter of the bearing housing connection is between 7.600 inches and 7.630 inches (or between 193.04 mm and 193.80 mm).

7. The inner housing of claim 1, wherein an external diameter of the cooling air inlet is no less than 2.685 inches (or no greater than 68.20 mm).

8. The inner housing of claim 1, wherein an external diameter of the cooling air inlet is between 2.685 inches and 2.715 inches (or between 68.20 mm and 68.96 mm).

9. The inner housing of claim 1 further comprising:
- acoustic foam occupying at least most of a volume between the perforated cone and the center body housing and between the perforated cone and the end cup.

10. A ram air fan assembly comprising:
- a fan housing;
- a fan motor attached to the fan housing;
- a fan rotor;
- a thrust shaft connecting the fan motor to the fan rotor;
- an inlet housing connected to the fan housing;
- a bearing housing attached to the fan housing;
- an outer housing connected to the fan housing; and
- an inner housing attached to the bearing housing for diffusing fan air from the fan rotor and directing cooling air to the bearing housing, the inner housing comprising:
  - a center body housing comprising:
    - a bearing housing connection having a cylindrical shape at one end of the center body housing and disposed symmetrically about an axis of the inner housing;
    - a cooling air inlet having a cylindrical shape at an end of the center body opposite the bearing housing connection; and a cooling duct between the bearing housing connection and the cooling air inlet, the cooling duct comprising:

a first cone attachment surface adjacent to the bearing housing connection, the first cone attachment surface having a frustoconical shape and disposed symmetrically about the axis of the inner housing;

an end cup attached to the center body housing, the end cup comprising:

a cooling air connector for connecting the end cup to the cooling air inlet;

a second cone attachment surface having a frustoconical shape and disposed symmetrically about the axis of the inner housing; and a cooling tube recess between the cooling air connector and the second cone attachment surface, the cooling tube recess for accepting a motor bearing cooling tube;

a perforated cone having a frustoconical shape and disposed axially about the center body housing;

wherein the perforated cone is attached to the center body housing at the first cone attachment surface and attached to the end cup at the second cone attachment surface such that the perforated cone extends away from the first cone attachment surface and radially inward toward the axis of the inner housing.

11. The ram air fan assembly of claim 10, wherein the perforated cone extends away from the first cone attachment surface and radially inward toward the axis of the inner housing at an angle of between 5.2 degrees and 5.6 degrees from the axis of the inner housing.

12. The ram air fan assembly of claim 10, wherein the perforated cone extends away from the first cone attachment surface and radially inward toward the axis of the inner housing at an angle of about 5.4 degrees from the axis of the inner housing.

13. The ram air fan assembly of claim 10, wherein a ratio of an external length of the inner housing to an external diameter of the bearing housing connection is no less than 1.347, wherein the external length of the inner housing is a distance in a direction parallel to the axis of the inner housing.

14. The ram air fan assembly of claim 10, wherein a ratio of an external length of the inner housing to an external diameter of the bearing housing connection is no less than 1.347 and no greater than 1.368, wherein the external length of the inner housing is a distance in a direction parallel to the axis of the inner housing.

15. The ram air fan assembly of claim 10, wherein an external length of the inner housing is between 10.275 inches and 10.395 inches (or between 260.99 mm and 264.03 mm) and an external diameter of the bearing housing connection is between 7.600 inches and 7.630 inches (or between 193.04 mm and 193.80 mm).

16. The ram air fan assembly of claim 10, wherein an external diameter of the cooling air inlet no less than 2.685 inches (or no greater than 68.20 mm).

17. The ram air fan assembly of claim 10, wherein an external diameter of the cooling air inlet is between 2.685 inches and 2.715 inches (or between 68.20 mm and 68.96 mm).

18. The ram air fain assembly of claim 10 further comprising:

acoustic foam occupying at least most of a volume between the perforated cone and the center body housing and between the perforated cone and the end cup.

19. A method for installing a ram air fan inner housing in a ram air fan assembly, the inner housing comprising an end cup, a ring seal, and a center body having a bearing housing connection, the method comprising:

inserting the inner housing into a fan outlet of the ram air fan assembly;

pulling electrical wires connected to a motor stator into the inner housing;

connecting the bearing housing connection to a bearing housing;

connecting a wire transfer tube to the ring seal;

feeding the electrical wires through the ring seal and through the wire transfer tube to a terminal box;

connecting the electrical wires to the terminal box;

connecting a motor bearing cooling tube to a cooling tube recess in the end cup; and installing the ram air fan assembly in an environmental control system.

* * * * *